US005291990A

United States Patent [19]

Sejzer

[11] Patent Number: 5,291,990

[45] Date of Patent: Mar. 8, 1994

[54] PRODUCT PACKAGING AND DISPLAY SYSTEM

[76] Inventor: Daniel A. Sejzer, 1815 Beverly Pl., Highland Park, Ill. 60035

[21] Appl. No.: 18,366

[22] Filed: Feb. 16, 1993

[51] Int. Cl.[5] ..... B65D 21/02; B65D 85/57

[52] U.S. Cl. ..... 206/45.110; 206/311; 206/312; 206/387; 206/459.5; 206/499; 206/526; 206/820; 220/23.83

[58] Field of Search ..... 206/309, 311, 312, 387, 206/45.11, 390, 499, 820, 526, 459.5; 220/23.83

[56] References Cited

U.S. PATENT DOCUMENTS

| | | | |
|---|---|---|---|
| 294,938 | 3/1884 | Traver | 206/45.11 X |
| 1,000,880 | 8/1911 | Anderson | 206/45.11 |
| 1,167,847 | 1/1916 | Schoettle | 206/45.11 |
| 1,386,398 | 8/1921 | Davis | 206/499 X |
| 4,502,596 | 3/1985 | Saetre et al. | 206/387 |
| 4,762,225 | 8/1988 | Henkel | 206/311 |

FOREIGN PATENT DOCUMENTS

| | | | |
|---|---|---|---|
| 1137051 | 5/1957 | France | 206/45.11 |
| 2143121 | 2/1985 | United Kingdom | 206/387 |

*Primary Examiner*—Bryon P. Gehman

*Attorney, Agent, or Firm*—Hill, Steadman & Simpson

[57] ABSTRACT

A packaging and display system includes a plurality of items having a substantially similar shape and size but differing product identifying indicia being provided on respective display surfaces of the items. The items are connected together in a chain by hinges mounted in alternating fashion along the chain between front and back surfaces of the items. A releasable attachment means is provided on each of the items so that when the items are folded together to form a compact bundle, the bundle is retained until pulled apart. When the items are unfolded, the items can assume a chain-like configuration in either a zig-zag pattern or a straight line pattern.

19 Claims, 1 Drawing Sheet

FIG. 1
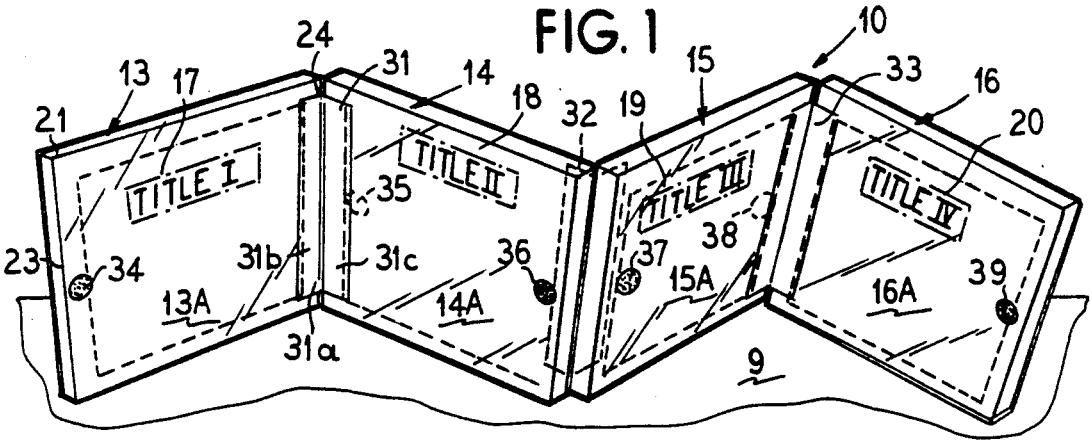
FIG. 2
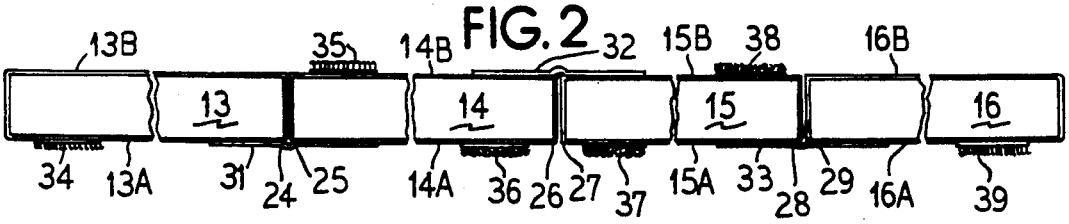
FIG. 3
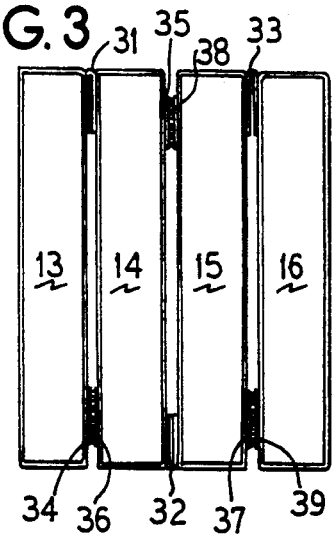
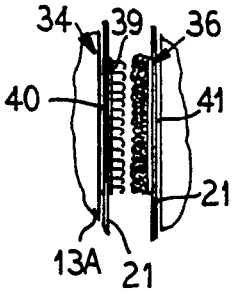
FIG. 4
FIG. 5
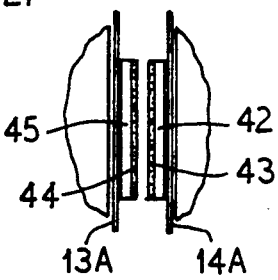
FIG. 6
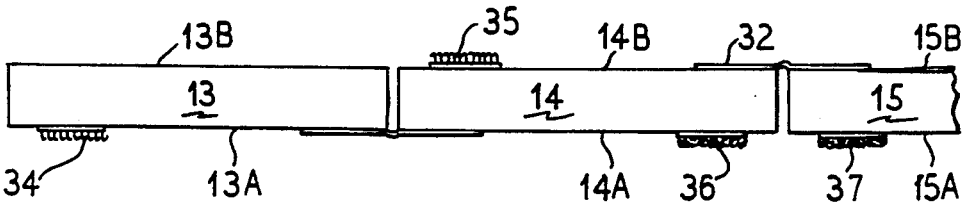

PRODUCT PACKAGING AND DISPLAY SYSTEM

BACKGROUND OF THE INVENTION

The present invention relates to product packaging and display systems wherein a plurality of packages are of a similar shape and size but with differing products contained therein and having different product identifying indicia on the respective packages.

Frequently in marketing and distribution of products, the products have a similar overall shape and size, but which differ from each other in other aspects, are packed in either identical or similar size packaging. Because the products differ from each other in the respective packages, the product identifying indicia on the face of the packages thus differs (even though they may belong to a common group or series). For example, in the marketing and sale of computer software packages such as video games, each package typically comprises a box having a thin profile and each contains a computer disk together with a written instruction manual for operation of the disk. Since all of the instruction manuals and disks are of a same size and shape, the respective boxes or packages which contain each of the games is of a same size and shape, but have different software identifying indicia thereon such as different titles, different promotional or marketing indicia on the face thereof, and differing instructions or other marketing indicia on the back surface thereof.

Typically, it is desirable that a consumer be able to read both the front and back of the package so that the consumer can quickly determine how each of the different products of a similar category differ from each other. In addition to computer games or other types of similar software products, this is also true for other product categories such as records, CD disks, packaging containing books, etc. Also, it is possible that the products themselves may not even be enclosed within a package but may be only "shrink wrapped" or in some cases not protected at all.

In the above situations, it has been known previously in the prior art to ship such items in groups with the items being placed directly adjacent each other, and the overall bundle of packages is shrink wrapped or held together by other means such as tape.

If the consumer then desires to read the front and/or back panel surfaces of each of the packages or products, it is necessary that the consumer first break apart the items so that the consumer can then read the indicia on each package separately after they have been separated. However, now that they have been separated, the individual packages of the series of packages may be lost, or it may be difficult to display them as a unit.

Frequently with such series of packages having a same size and shape but with differing product identifying indicia thereon, it is desirable to maintain them together as a unit for display purposes so that the consumer may buy the entire group of packages. Once they are separated, however, they may be lost, or the store marketing the items may have to reattach them prior to sale.

SUMMARY OF THE INVENTION

It is an object of the invention to provide a system whereby a plurality of packages or products of a similar size and shape and preferably of a same type, group, or series, can be conveniently attached together as a bundle, yet permitting a consumer to look at the indicia identifying each of the products without separating the packages from the overall bundle.

According to the invention, a plurality of items which may be either separate packages or products of a given series and of similar shape and size, are connected together in a bundle by use of flexible hinges attaching the packages together in chain-like fashion at first side edges thereof, and at opposite side edges a releasable connection means is provided. With the system of the invention, with the items folded against one another in zig-zag fashion, an overall bundle is formed. However, a consumer may then open up the bundle so that a chain of the packages results which enables the consumer to read the front and back panels of each of the packages or products and then fold the packages or products back against one another in zig-zag fashion to reform the bundle.

Preferably, the hinges comprise flexible polyethylene hinges which are non-releasably attached such as to a shrink wrap of the packages. The releasable attachment means preferably comprise Velcro or adhesive dots also attached to the shrink wrap of the package at opposite side edges on each of the packages. Packages lying inwardly of the ends of the chain of packages also have adhesive dots on the back panel of the package on the shrink wrap. When at least four packages are provided, hinges connecting the end items of the chain are at the front surface and the hinge containing the middle two items or units is on the respective back surfaces of these items.

BRIEF DESCRIPTION OF THE DRAWINGS

FIG. 1 is a perspective view showing a packaging and display system according to the invention with a bundle of items being partially opened so as to form a chain of items in a zig-zag configuration;

FIG. 2 is a top view of the open bundle shown in FIG. 1 but with the items of the bundle unfolded to form a straight line chain;

FIG. 3 is a top view of the bundle with the items folded against one another;

FIG. 4 is a detailed view of the releasable attachment means employed in the invention;

FIG. 5 is an alternate embodiment of the releasable attachment means of FIG. 4; and FIG. 6 is an alternate embodiment showing the products or packages attached but without shrink wrap being provided on each package or product.

DESCRIPTION OF THE PREFERRED EMBODIMENTS

As generally shown at 10 in FIG. 1, a packaging and display system according to the invention employs a chain-like interconnection of a plurality of identical or similarly shaped items 13, 14, 15, and 16. These items are preferably product packages which are individually shrink wrapped by a shrink wrap 21 (shown by shading only for the first package) as shown at FIG. 1. Alternatively, the items 13, 14, 15, and 16 can be packages which are not shrink wrapped, or can be the products themselves. Typically the products or the products contained within the similarly shaped packages also have a similar size and shape such as computer disks, printed materials such as instructions for the computer disks, CDs, books, etc. Typically the respective front surfaces 13*a*, 14*a*, 15*a*, 16*a* of the packages or products have a differing product identifying indicia thereon indicated at title blocks I, II, III, and IV, as shown at 17, 18, 19, and 20. In this partially opened configuration of the bundle, it can be appreciated that a consumer may easily read the different titles on the front surfaces or even differing indicia on the back surfaces of each of the individual packages, even though the packages remain attached together in a bundle in chain-like fashion. Also, in the partially unfolded zig-zag configuration shown in FIG. 1, it can be appreciated that the packages can be stood up without additional support on a display surface 9 such as a store shelf.

In the configuration shown in FIG. 1 or FIG. 2, either the front surfaces 13*a*, 14*a*, 15*a*, 16*a* or the back surfaces 13*b*, 14*b*, 15*b*, 16*b* can be easily read by the consumer.

As shown in FIGS. 1 and 2 most clearly, packages 13 and 16 at the end of the chain are attached to respective intermediate packages 14 and 15 by respective clear plastic or polyethylene hinges 31, 33. Packages 14 and 15 are joined by hinge 32 at the back. Each of the hinges has a bending line such as shown at 31*a* and attachment leaves 31*b* and 31*c*. The attachment leaves 31*b* and 31*c* are mounted by an adhesive layer to the shrink wrap surrounding the package surfaces. The adhesive layer is chosen to have a sufficient strength to hold the items together in the chain, but also are sufficiently releasable to allow a user to separate the packages with moderate force. Thus, when the shrink wrap is removed, the hinge is automatically removed. The adhesive layer is employed on the back of the hinge for attaching the polyethylene hinge to the shrink wrap or directly to the package or product. Preferably, the hinge has a longitudinal extent which is less than an edge length of the edge 24. Also preferably the hinge is clear so that, in the event it covers any of the indicia on the front surface 13*a* of the package, that indicia can still be read through the hinge. Also by use of a clear hinge, the overall aesthetics of the front surface of the package are not distorted.

Laterally opposite the hinge is a releasable attachment member 34 which in a preferred embodiment is, as shown in FIG. 4, a loop portion 39 of a hook and loop Velcro fastening system. As shown in FIG. 4, the attachment member 34 is in the shape of a round dot which is attached by a non-removable adhesive layer 40 to the shrink wrap 21 overlying the surface 13*a* of the package 13. The dot 34 lies adjacent the vertical side edge 23 which is laterally opposite the side edge 24 at the front surface 13*a*. Preferably it lies half-way between the top and bottom of the package.

On the next adjacent package 14, the front surface 14*a* also has a mating releasable attachment member 36 which is preferably the loop portion of the Velcro attachment system as shown in FIG. 4. The loop portion is attached by a mounting adhesive layer 41 to the shrink wrap 21 on the front surface 14*a* of the package 14. The dot 36 is lined up with the dot 34 so that when the packages 13 and 14 are closed upon one another, the dots line up and mate. The releasable attachment members 34 and 36 together form a releasable attachment system.

Similarly, dots 37 and 39 are provided at the other end of the chain for boxes or packages 15 or 16. Similarly, a hinge 33 is provided.

On the intermediate packages 14 and 15, at the back surfaces 14*b* and 15*b*, hook and loop members 35 and 38 form releasable attachment members at the back surfaces so that when the intermediate packages 14 and 15 are closed upon one another, the releasable attachment members 35 and 38 releasably join.

In the top view of FIG. 2, the overall relationship of the hinges and attachment members to the various side edges 23, 24, 25, 26, 27, 28, 29, and 30 at the front of the packages is shown.

In FIG. 3, a top view of the bundle with the packages closed upon one another is shown.

In FIG. 5 an alternate embodiment of the releasable attachment members is indicated whereby instead of a hook and loop velcro system, a releasable adhesive layer 43 or 44 is provided on top of a further mounting adhesive layer 42 and 45.

In FIG. 6, the alternate embodiment of the invention is shown wherein no shrink wrap is provided and wherein the releasable attachment members and hinges are directly attached to the package itself, or to the product.

With the invention, a consumer may unfold the bundle into either a straight chain of packages or into a zig-zag chain allowing set-up, such as on a display shelf. When the shrink wrap is removed, both the releasable attachment members and the hinges are automatically removed along with the shrink wrap. When the consumer is finished reading the various indicia on each of the packages, the chain of packages can then be folded again into a small convenient bundle.

Although a chain of four packages has been shown, a longer chain formed of more packages can be employed, or a shorter chain formed of fewer packages.

Although various minor changes and modifications might be proposed by those skilled in the art, it will be understood that I wish to include within the claims of the patent warranted hereon all such changes and modifications as reasonably come within my contribution to the art.

I claim as my invention:

1. A packaging and display system, comprising:

a plurality of items each having a substantially similar shape and size and a display surface containing product identifying indicia but wherein the product identifying indicia differs for at least two of the items;

the items being connected together in a chain by hinges mounted at a side edge of the items in alternating fashion along the chain between front and back surfaces of the items;

a releasable attachment member being provided on each of the items adjacent a side edge laterally opposite the side edge where the respective hinge is mounted and on a same respective front or back surface of each of the items where the respective hinge is mounted; and the hinges and releasable attachment members being arranged and located such that the items can be closed upon one another into a compact bundle or can be unfolded by release of the releasable attachment members so that the individual items can assume a linked together configuration in either a zig-zag pattern or a straight line pattern.

2. A system according to claim 1 wherein the arrangement and location of said hinges and releasable attachment members allows the items to be unfolded into said zig-zag pattern such that said zig-zag pattern allows the items to be stood upright in self-supporting manner on a flat surface.

3. A system according to claim 1 wherein said releasable attachment members comprises hook and loop mating Velcro attachment members.

4. A system according to claim 3 wherein each of the attachment members is in the form of round dots.

5. A system according to claim 3 wherein each of the attachment members has an adhesive layer means for sticking on the items.

6. A system according to claim 1 wherein said releasable attachment members each comprise a releasable adhesive layer for mating with one another.

7. A system according to claim 6 wherein said releasable adhesive layer is mounted onto a further adhesive layer means for mounting to the respective surfaces of the items.

8. A system according to claim 1 wherein each item comprises a box containing a product therein.

9. A system according to claim 8 wherein each box is separately wrapped with a shrink wrap film and the releasable attachment members and hinges are attached to the film.

10. A system according to claim 8 wherein the hinges and releasable attachment members are directly connected to surfaces of the boxes.

11. A system according to claim 1 wherein each of the items comprises a box containing computer software, and wherein all of the boxes represent different software titles of a related series.

12. A system according to claim 1 wherein the hinges comprise clear plastic hinges having an adhesive layer means on one surface for mounting at respective surfaces of the items.

13. A system according to claim 1 wherein at least four items are provided in the system, a middle two of the items being connected by a hinge at a back surface thereof, all four items having releasable attachment members at the front surfaces at the side edge opposite where the side edge where the hinges are located, and the two inner items having releasable attachment means at respective side edges on the respective back surfaces opposite the respective side edges where the back hinge is mounted.

14. A system according to claim 1 wherein all of the products, although differing from one another, belong to a same group.

15. A system according to claim 1 wherein all of the products belong to a same series.

16. A packaging and display system, comprising:

a plurality of items which are to be sold together as a unit;

the items being connected together in a chain by hinges mounted at side edges of the items in alternating fashion along the chain between front and back surfaces of the items;

said hinges having adhesive attachment means for permitting the hinges to be pulled off of the individual items so as to permit separation of the items when desired; and the hinges being positioned to connect the items so that when the items are unfolded they form a zizzag or straight line pattern in a linked together configuration and when folded comprise a compact bundle.

17. A system according to claim 16 wherein a releasable attachment means is provided on each of the items adjacent a side edge laterally opposite the side edge wher the hinge is mountd but on a same surface of each of the items as the respective hinge so that when the items are folded together into said compact bundle, they are retained together until pulled apart.

18. A system according to claim 16 wherein each of the items has a substantially same shape and size.

19. A system according to claim 16 wherein each of the items has a substantially same shape and size but comprise products identified by different product identifying indicia, and the products, although belonging to a common series, being different from one another so that the product identifying indicia on a display surface of at least two of the items differ from one another.

* * * * *